US007377065B2

(12) United States Patent
Myatt et al.

(10) Patent No.: US 7,377,065 B2
(45) Date of Patent: May 27, 2008

(54) SIGNAGE RETROFIT KIT FOR VENDING MACHINES

(75) Inventors: John Myatt, Charles Town, WV (US); Kevin Steeley, Charles Town, WV (US); Todd Washburn, O'Fallon, MO (US); Tom Holland, Nashville, TN (US)

(73) Assignee: DALB, Inc., Kearneysville, WV (US)

( * ) Notice: Subject to any disclaimer, the term of this patent is extended or adjusted under 35 U.S.C. 154(b) by 0 days.

(21) Appl. No.: 10/690,825

(22) Filed: Oct. 23, 2003

(65) Prior Publication Data

US 2004/0139640 A1 Jul. 22, 2004

Related U.S. Application Data

(60) Provisional application No. 60/420,251, filed on Oct. 23, 2002.

(51) Int. Cl.
*G09F 7/02* (2006.01)

(52) U.S. Cl. ..... 40/611.01; 40/594

(58) Field of Classification Search ..... 40/611.1, 40/611.06

See application file for complete search history.

(56) References Cited

U.S. PATENT DOCUMENTS

| | | | |
|---|---|---|---|
| 1,897,072 | A | 2/1933 | Parks et al. |
| 2,261,338 | A | 11/1941 | Carlson |
| 2,271,689 | A | 2/1942 | Fritz |
| 2,392,511 | A | 1/1946 | Thompson et al. |
| 2,654,172 | A | 10/1953 | Solomon |
| 2,871,081 | A | 1/1959 | Greene et al. |
| 3,367,730 | A | 2/1968 | Andrews et al. |
| 4,245,730 | A | 1/1981 | Bachmann et al. |
| 4,320,933 | A | 3/1982 | Felix et al. |
| 4,377,049 | A | 3/1983 | Simon et al. |
| 4,380,130 | A | 4/1983 | Bachmann et al. |
| 4,454,670 | A | 6/1984 | Bachmann et al. |
| D286,793 | S | 11/1986 | Schoultz |
| D287,863 | S | 1/1987 | Cedrone et al. |
| D290,269 | S | 6/1987 | McGarrah |
| D290,270 | S | 6/1987 | McGarrah |
| D290,271 | S | 6/1987 | McGarrah |

(Continued)

FOREIGN PATENT DOCUMENTS

| | | |
|---|---|---|
| GB | 2194662 | 3/1988 |

OTHER PUBLICATIONS

Two photos of Doritos Machine.

(Continued)

*Primary Examiner*—Cassandra Davis
(74) *Attorney, Agent, or Firm*—Timothy J. Klima

(57) ABSTRACT

A holder of product identification indicia incorporated with a specifically printed illuminated sign in a beverage vending machine. The holder allows enhanced product identification relating to a separate, existing selection button panel. The holder is securely attached to the back of the illuminated sign that has clear viewing windows registered to the holder. Specifically, it is intended as a retrofit kit for existing beverage vending machines to allow the display of product contained in the machine by use of significantly larger product identification indicia than the existing product identification indicia. The larger display windows may be specifically correlated to the existing selection mechanisms by way of numbers, letters, symbols, connecting lines and/or colors.

5 Claims, 9 Drawing Sheets

U.S. PATENT DOCUMENTS

| | | | | |
|---|---|---|---|---|
| D290,272 | S | 6/1987 | McGarrah | |
| 4,682,709 | A | 7/1987 | Brandes et al. | |
| 4,973,109 | A | 11/1990 | Diedrich | |
| D314,795 | S | 2/1991 | McGarrah | |
| D314,796 | S | 2/1991 | McGarrah | |
| 5,018,291 | A | 5/1991 | Pasquale et al. | |
| 5,090,589 | A | 2/1992 | Brandes et al. | |
| D326,477 | S | 5/1992 | Cunningham | |
| 5,207,011 | A | 5/1993 | Coulthard | |
| 5,255,968 | A | 10/1993 | Craven | |
| 5,383,297 | A | 1/1995 | Summerville et al. | |
| 5,440,321 | A | 8/1995 | Hine, Jr. | |
| 5,457,905 | A | 10/1995 | Kaplan | |
| 5,471,794 | A | 12/1995 | Nishioka | |
| 5,488,656 | A | 1/1996 | DeArkland | |
| 5,505,333 | A | 4/1996 | Shibazaki et al. | |
| 5,509,225 | A | 4/1996 | Minh et al. | |
| 5,598,655 | A | 2/1997 | McGarrah | |
| D384,976 | S | 10/1997 | McGarrah | |
| D384,977 | S | 10/1997 | McGarrah | |
| 5,680,721 | A | 10/1997 | Hine, Jr. | |
| D388,831 | S | 1/1998 | McGarrah | |
| D396,490 | S | 7/1998 | Jack | |
| 5,803,560 | A | 9/1998 | Trulaske, Sr. et al. | |
| 5,956,876 | A | 9/1999 | Burdette et al. | |
| 6,023,870 | A * | 2/2000 | McGarrah | 40/606.02 |
| 6,058,638 | A | 5/2000 | Slattebrekk | |
| 6,067,738 | A | 5/2000 | Zeligson | |
| 6,073,801 | A | 6/2000 | McGarrah | |
| 6,128,842 | A | 10/2000 | Lotspeich et al. | |
| 6,185,785 | B1 | 2/2001 | Kingston | |
| 6,195,924 | B1 | 3/2001 | Rudick et al. | |
| 6,216,374 | B1 * | 4/2001 | Lawrence | 40/604 |
| 6,230,426 | B1 | 5/2001 | Fakhoury et al. | |
| 6,298,589 | B1 | 10/2001 | Hillstrom | |
| 6,374,523 | B1 | 4/2002 | Smith | |
| 6,386,389 | B1 | 5/2002 | Percy et al. | |
| 6,493,974 | B2 | 12/2002 | Tramont | |
| 6,499,242 | B2 | 12/2002 | Rudick et al. | |
| 6,618,972 | B2 | 9/2003 | Bar-Yona | |
| 2004/0128889 | A1 * | 7/2004 | Chirnomas et al. | 40/611.1 |
| 2006/0201776 | A1 * | 9/2006 | Myers et al. | 194/350 |

OTHER PUBLICATIONS

Seven Photos of Dr. Pepper Machine.

* cited by examiner

SIGNAGE RETROFIT KIT FOR VENDING MACHINES

This application claims priority to U.S. Provisional Patent Application Ser. No. 60/420,251, filed Oct. 23, 2002, the contents of which are incorporated by reference herein.

BACKGROUND OF THE INVENTION

Since the 1940's, the beverage industry has utilized vending machines as a means of selling cold beverages to consumers. Since that time, there has been a distinct evolution in beverage vending machine design in an effort to better communicate with the consumer and thus sell more beverages. Early models of beverage vending machines concentrated on ornamental shapes of the actual machine to appeal to consumers. From there, increasing emphasis was put on graphics as a way of identifying the beverage company whose products were within the machine. Further evolution led to the use of illuminated signage. This illuminated signage eventually comprised the majority of the front of the vending machine by the mid-1980's.

At this point, beverage companies recognized the importance of depicting a picture of one of the products contained in the machine. The actual product in the machine was represented by indicia located in or immediately adjacent to the specific selection button. This indicia was generally a small, rectangular card approximately 1"×3". By the end of the $20^{th}$ century, the trend in design shifted to more prominent display of the indicia relating to the specific selection buttons. As a reference, the size of the product selection indicia increased 200%-500% on new equipment used by the major beverage companies.

This has resulted in a dilemma over the marketing usefulness of existing beverage vending equipment. It is important to note that there are conservatively 2,000,000+pieces of beverage vending equipment in the market today that are limited in the size of product identification indicia that can be used. This is leading to premature obsolescence of useful beverage vending machines due to inadequate product identification indicia size relative to the new equipment designs.

Existing beverage vending equipment currently uses product identification indicia on or immediately adjacent to the actual switch that will deliver a given product selection. The existing product identification indicia are approximately 1"×3". This is believed to create difficulty and confusion for the consumer on the choice of product, as the product identification indicia are difficult to read due to their size.

SUMMARY OF THE INVENTION

A signage retrofit fit kit for a vending machine includes a sign having a front side visible by a customer of the vending machine and a rear side facing the vending machine. The sign is attachable to a front portion of the vending machine and has at least one window portion through which an item located on the rear side of the sign can be viewed from the front side of the sign. The window portion is spaced apart from a product identification window of a selection panel of the vending machine and has a size greater than a size of the selection panel product identification window. The kit also includes a holder constructed and arranged to be positioned on the rear side of the sign, the holder also being constructed and arranged to hold a remote product identifier such that the remote product identifier is viewable from the front side through the window portion of the sign, the remote product identifier also having a size greater than the size of the selection panel product identification window.

The present invention has been specifically designed as an improvement on beverage vending equipment produced from 1985 to the present and provides a means of utilizing significantly larger (approximately 5"×7") remote product identifiers without mechanical alteration to the vending machine. This is a tremendous benefit to the beverage industry in that it transforms a machine with inferior product identification indicia into a vending machine with product identification indicia comparable to new beverage vending equipment. The economic impact is significant. Consider the following illustration:

Estimate of existing beverage vending machines: 2,000,000+

Estimate of machines with premature obsolescence: 100,000 (5%)

Estimate of new machine cost: $1500

Estimate of invention cost: $50

Potential industry savings (100,000×$1450): $145,000,000

A retrofit kit for existing beverage vending machines allows the display of product contained in the machine by means of significantly larger product identification indicia than the existing product identification indicia.

An enhanced product identification system for beverage vending machines utilizes a remote holder of product identifiers that correspond to the existing selection buttons on beverage vending equipment.

An enhanced product identification system for beverage vending machines utilizes a remote holder of product identifiers that correspond to the existing selection buttons on beverage vending equipment and also incorporates a holder of advertising indicia.

The product identifiers can be viewed through clear windows that are registered to the holder in an illuminated sign on a beverage vending machine.

The clear windows in the illuminated sign can have identification printed on them that relate to the particular selection button for the particular product depicted in that clear window.

The holder can be attached to the back of the illuminated sign by bolts, clips or other fasteners that pass through the sign or by adhesive that bonds the holder to the sign.

The remote product identifiers can be positioned so that the existing vending machine lighting used for the sign can illuminate the product identifiers.

Accordingly, it is the primary object of this invention to provide a means in which product identification can be significantly enhanced while utilizing the existing selection switches.

It is another object of this invention to utilize a system of relating each product indicia to the appropriate switch through the printing of a number either on the illuminated sign or on the remote product identifier that corresponds to the selection button for that product.

It is another object of this invention to incorporate clear viewing windows in the illuminated sign so that the remote product identifier may be viewed. The clear viewing windows are registered to the holder.

It is another object of this invention to provide a holder of remote product identifiers that incorporates a series of tabs and/or channels that retains the larger product remote product identifiers.

It is another object of this invention to provide a holder of marketing indicia in addition to the product identification holder.

It is another object of this invention to utilize the existing illumination for the sign as a means of illuminating the remote product identifiers retained by the indicia holder.

It is another object of this invention to attach the holder to the back of the illuminated sign by means of bolts that pass through the sign or with adhesive. Other embodiments could include clips that pass through the sign or similar means of semi-permanent attachment.

BRIEF DESCRIPTION OF THE DRAWINGS

The detailed description of the invention references the accompanying drawings so as to provide a visual reference.

DETAILED DESCRIPTION OF THE PREFERRED EMBODIMENTS

Figure 1:
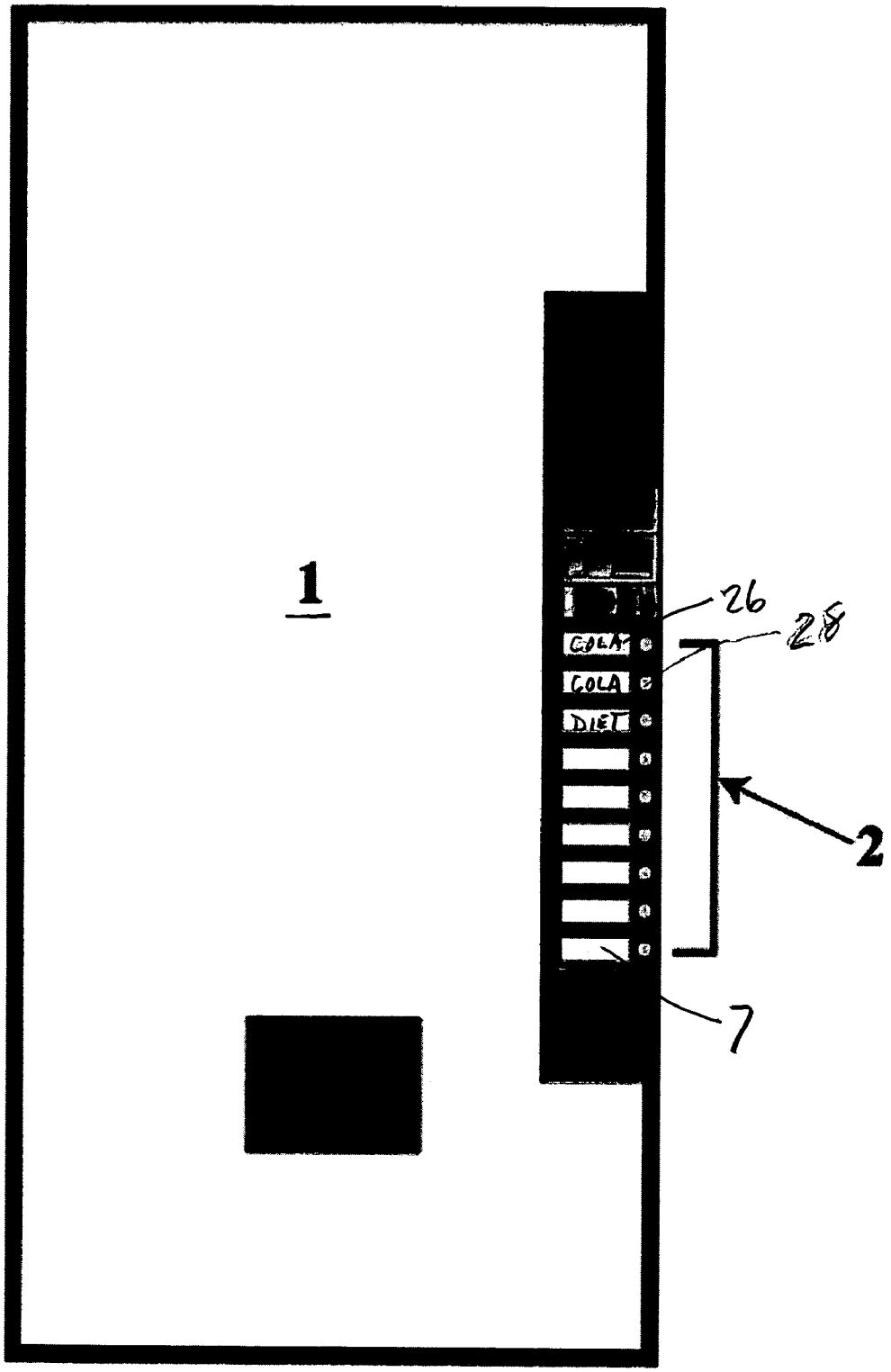
Figure 1 (Prior Art)
FIG. 1 (Prior Art) is a front elevational view of a typical beverage vending machine found in the marketplace having an illuminated sign that extends the entire height of said machine.
Figure 3:
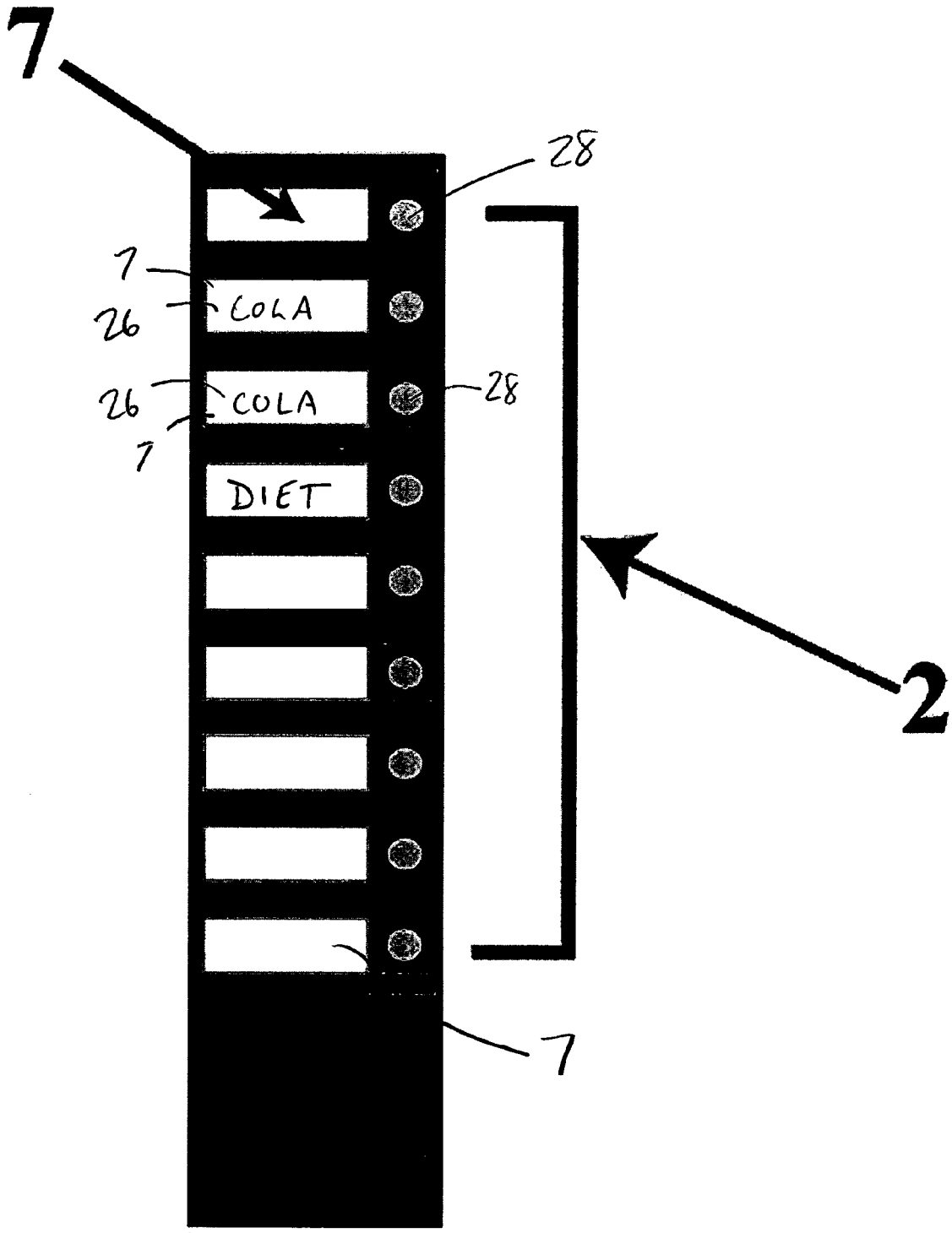
Figure 3 (Prior Art)
FIG. 3 (Prior Art) is a detail view of the existing product selection panel utilized on a typical beverage vending machine.

Referring to the drawings in more detail, FIG. 1 (Prior Art) depicts the front of a typical beverage vending machine. The front of a typical beverage vending machine includes a printed, generally full-length sign 1, usually of semi-flexible plastic typically held to the machine in a known manner by trim pieces and illuminated by lighting positioned in the interior of the vending machine. Product is selected by utilizing a vertical, selection panel 2 that is located to the right side of the front of the machine. The selection panel 2 includes small, rectangular product identification windows 7 (FIG. 3) through which product indicia 26 of the corresponding product contained within the machine can be viewed. The windows 7 can incorporate a switches, or separate switches in the form of buttons 28 can be provided adjacent the windows 7, as is known, so that product is selected by pushing either the actual window 7 or the button 28 adjacent to the window 7. A consumer must currently make a selection based solely on the small, rectangular product indicia 26 associated with each window 7. FIG. 3 (Prior Art) is an enlarged view of the selection panel 2 on a typical beverage vending machine.

Figure 2:
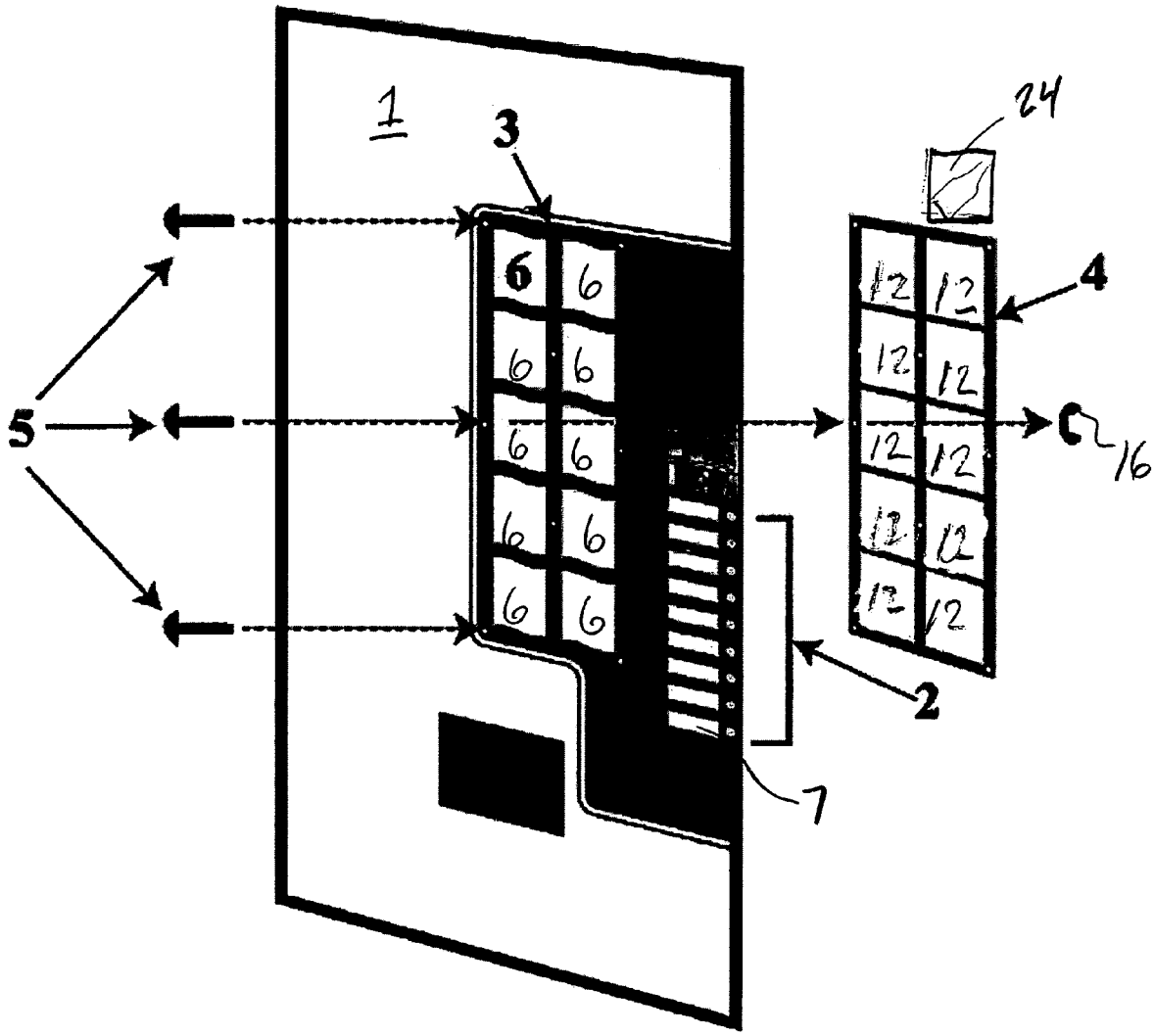
FIG. 2 is a perspective view of one preferred embodiment of the invention utilizing a generally vertical application.

FIG. 2 shows a perspective view of one of the preferred embodiments. A specially printed sign 1 is required that contains a generally vertical printed masking 3 with see through portions such as clear windows 6. The printed masking 3 is specifically located on the illuminated sign I previously mentioned. A holder 4 that contains a corresponding number of openings to the masking 3 is then attached to the back of the sign 1 and is registered to the printed masking 3. The holder 4, shown in the form of a lattice, is attached by means of threaded fasteners 5 that pass through the sign 1 and the lattice-type holder 4 and are retained by nuts 16. Other types of fasteners can also be used, such as clips, adhesives, hook and loop fasteners, etc. The lattice-type holder 4 is preferably made from flexible, impact resistant material such as polycarbonate but can be made from other materials. It contains openings 12 with retention capabilities such as channels or clips. The holder openings 12 are intended to retain remote product identifiers 24 spaced apart from corresponding selection panel product identification windows 7. The remote product identifiers 24 can be illuminated by the existing lighting in the machine. These remote product identifiers 24 can be in the form of cards, product packaging or in another form and can contain images, photos, text, etc. to identify a product contained within the vending machine.

The remote product identifiers 24 retained by the holder and depicted in the openings 12 specifically relate to the existing selection panel 2 product indicia 26. This can be done by way of corresponding identification in the holder openings 12 and selection panel buttons 7. Thus, a consumer may view the large remote product identifiers 24 through the windows 6 and the holder openings 12 and then make their selection by pressing the corresponding button 28 on the existing selection panel 2. The windows 6 can also be structured as cutouts in the sign 1 with a clear panel attached to the sign 1 and covering the cutouts. The remote product identifiers 24 are preferably at least 100% larger than the product indicia 26, more preferably between 200-500% larger and can be even larger as situations allow. In one embodiment, the product identifiers 24 are approximately 5"×7".

Figure 4:
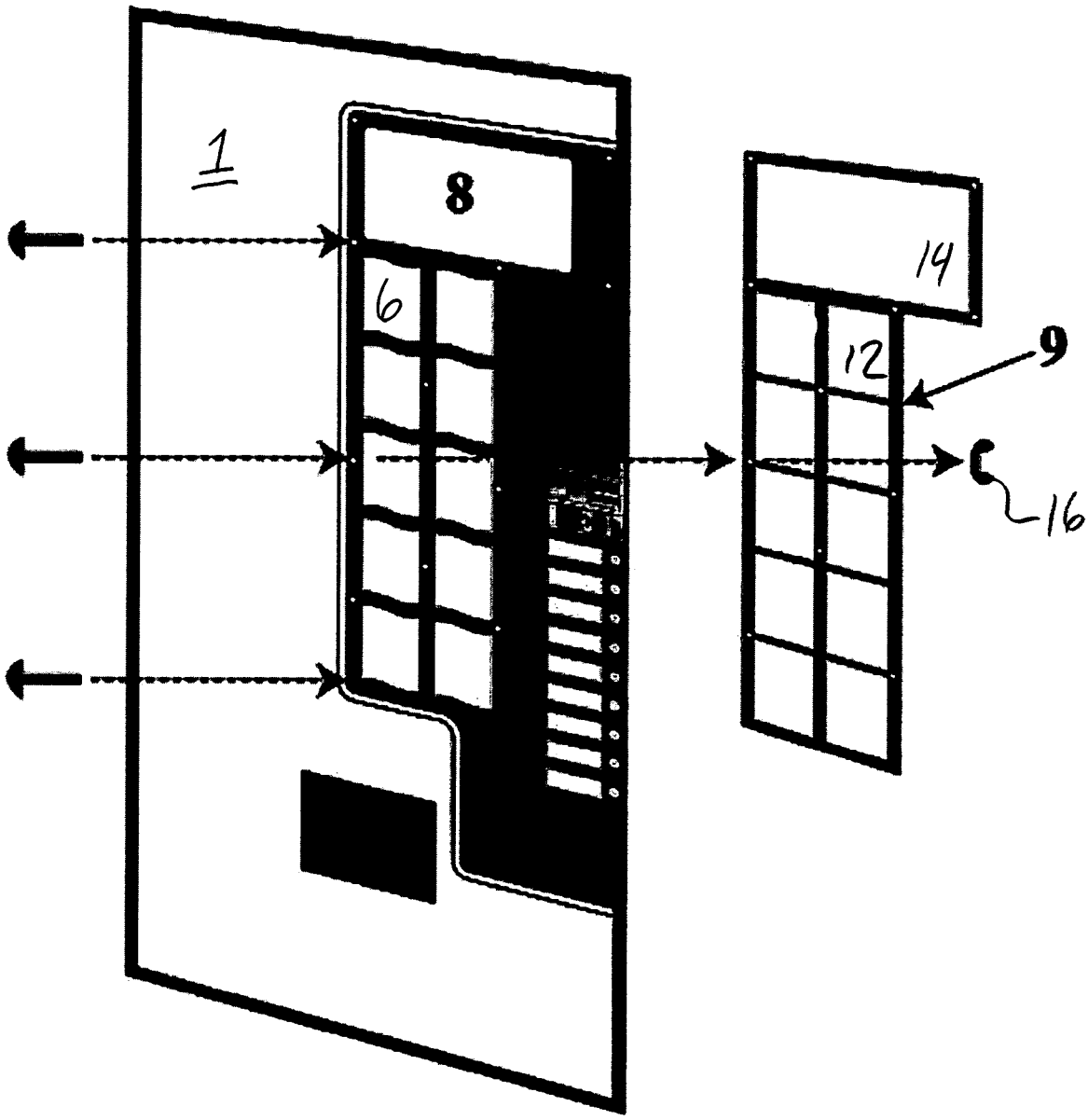
FIG. 4 is a perspective view of an alternative embodiment of the invention with an additional feature that allows for the introduction of removable advertising indicia.

FIG. 4 shows a perspective view that incorporates an additional element. In this embodiment, all characteristics previously described are retained with the addition of a printed masking that incorporates a large, advertising window 8. This advertising window 8 requires a corresponding holder 9 with large opening 14 that allows for the retention of advertising indicia that is illuminated using the existing machine lighting. It is attached to the back of the sign 1 using threaded fasteners 5 and is registered to the printed masking 8.

Figure 5:
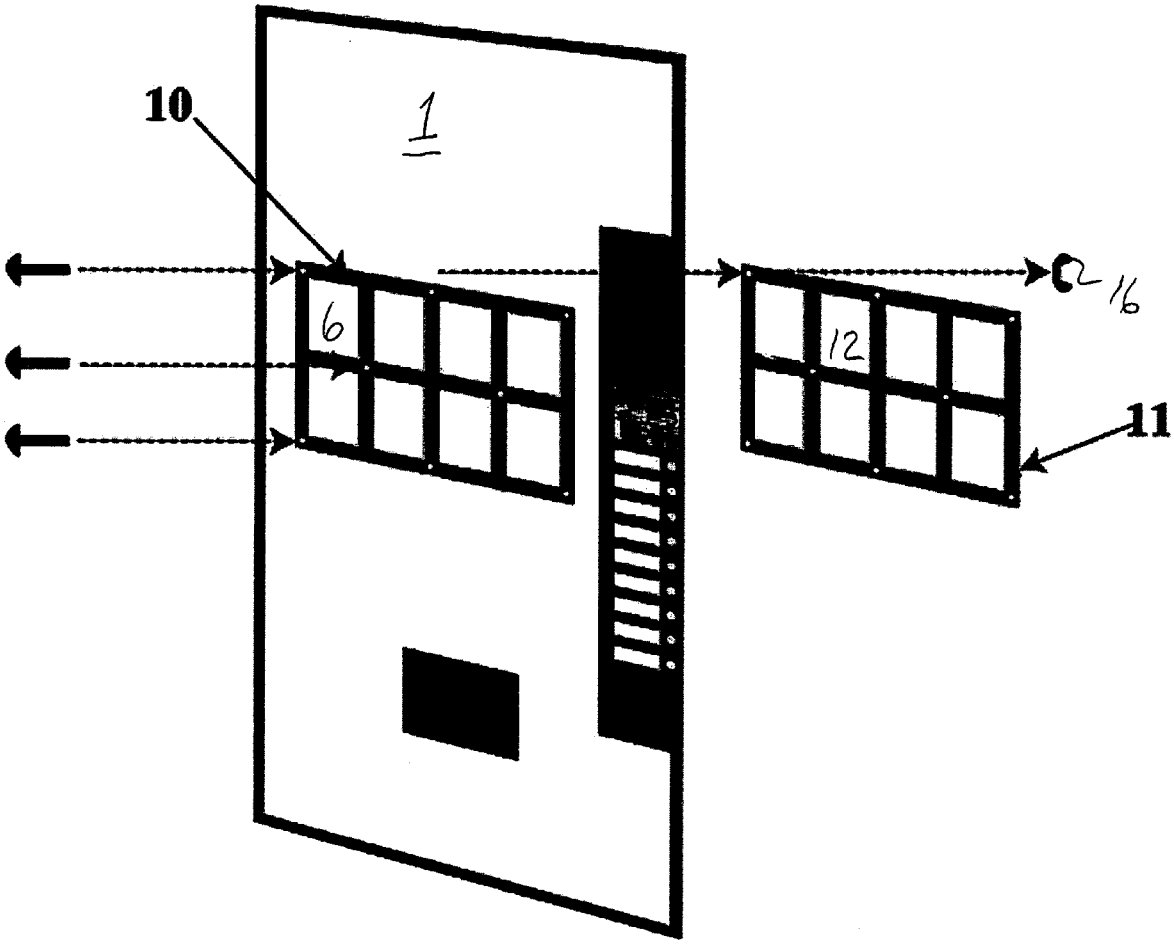
FIG. 5 is a perspective view of an alternative embodiment of the invention utilizing a generally horizontal application.

FIG. 5 shows another embodiment of this invention that utilizes a horizontal, printed masking 10 on an illuminated sign 1. This embodiment requires a corresponding horizontal holder 11, and utilizes some or all of the above mentioned features.

Figure 6:
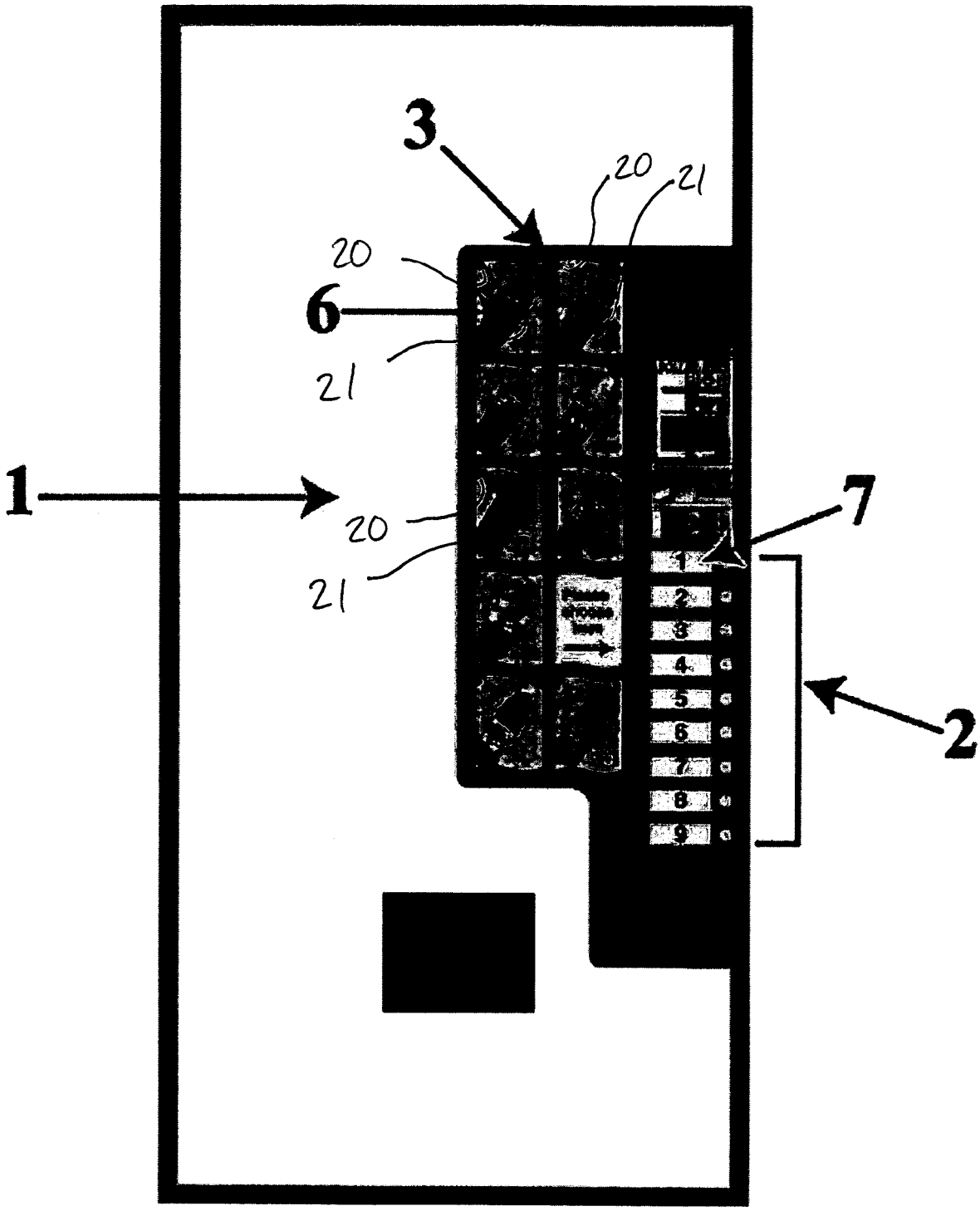
FIG. 6 is a front elevational view of the embodiment of FIG. 2 with graphics installed.
Figure 7:
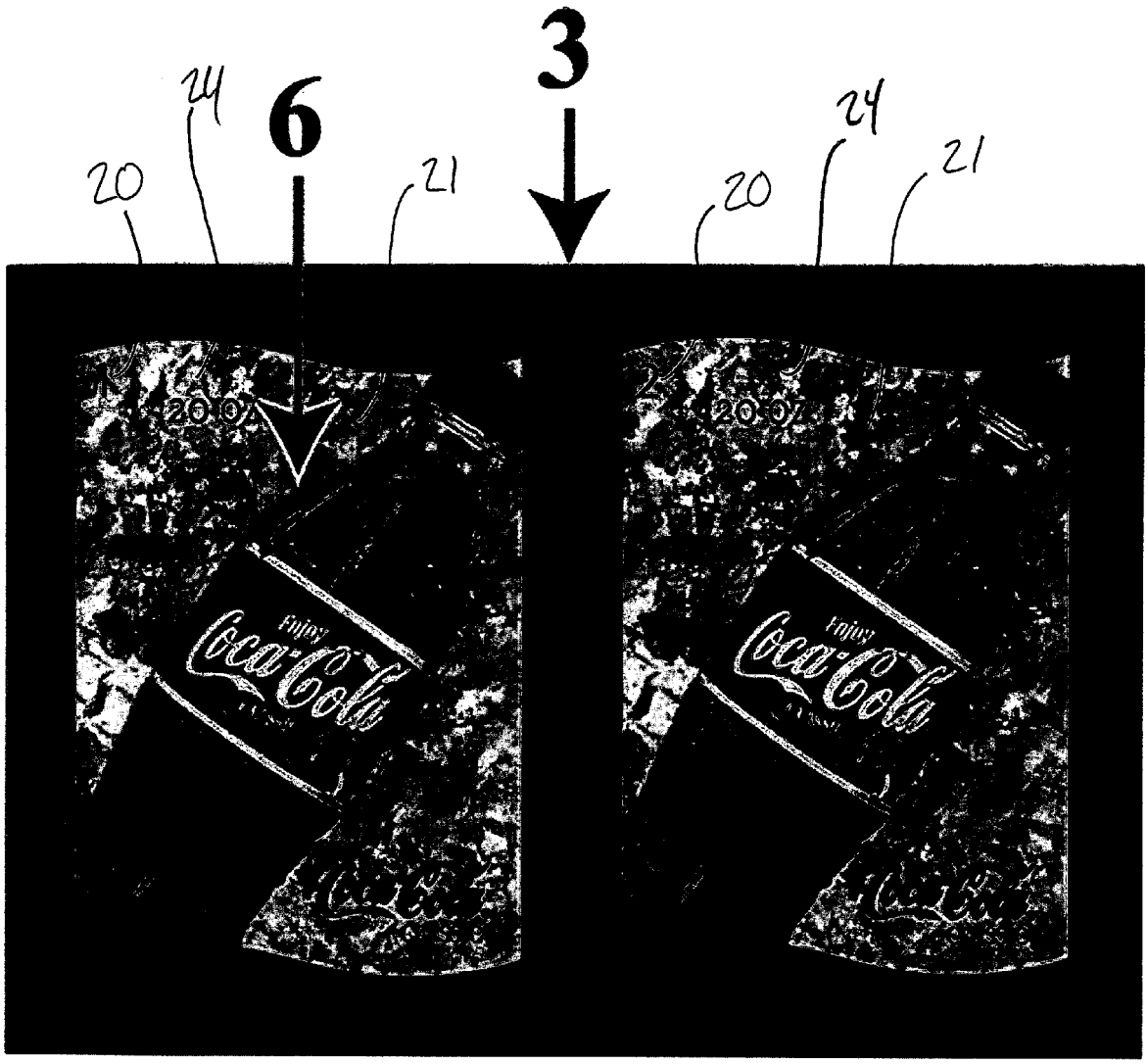
FIG. 7 is an enlarged detail view of FIG. 6.
Figure 7:
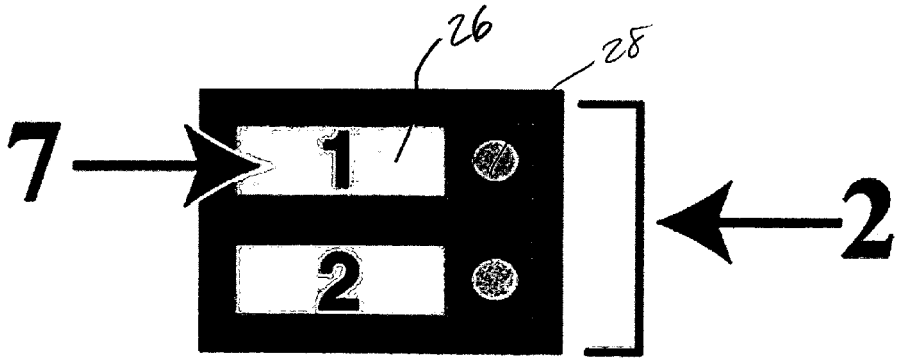

FIG. 6 is a front elevational view of the embodiment of FIG. 2 with remote product identifiers 24 installed. As can be seen, nine large remote product identifiers 24 with graphics images 21 can be displayed which correspond to the nine product selection buttons 28, respectively. Of course, the number of identifiers 24 can be changed as appropriate for the particular machine. FIG. 7 is an enlarged detail view of FIG. 6 and shows how the graphic images 21 for the selectable products are graphically associated with the corresponding product selection buttons 7 through use of respective product selection button numbers 20.

As shown in FIG. 7, the identifier 24 on the left (and corresponding vendable product shown on the graphic image 21 thereon) is associated with product selection button number 1 (see also FIG. 6) and associated vending structure while the identifier 24 on the right is associated with product selection button number 2. The product selection button numbers can be printed on the respective identifiers 24 or, preferably, can be printed on the windows 6, the holder openings 12 or on other structure associated with the retrofit kit so that individual selectable remote product identifiers 24 are not permanently associated with a particular product selection button 28 but can be arranged as desired in the holder openings 12 to be associated with whichever product selection buttons and corresponding machine vending structure as is desired/required. For instance, if it is desired to have the same vendable product associated with two product selection buttons (and corresponding vending structure) because of higher demand for that particular product, the same identifier 24 of that product can be used in different of the holder openings if the product selection numbers are not printed on the product image but on windows 6, holder openings 12, etc. Thus, through use of the present invention, the existing product selection windows 7 and/or buttons 28 can be used and associated with the larger graphic images on the remote product identifiers 24 of the various selectable products to give a fresh, modern marketing appearance to an old-style vending machine. Alternatively, there need not be additional numbers, text or other graphics linking each remote product identifier indicia with a corresponding button, but can be so linked by merely by comparison of the larger remote product identifier 24 with the corresponding smaller product indicia 26.

Figure 8:
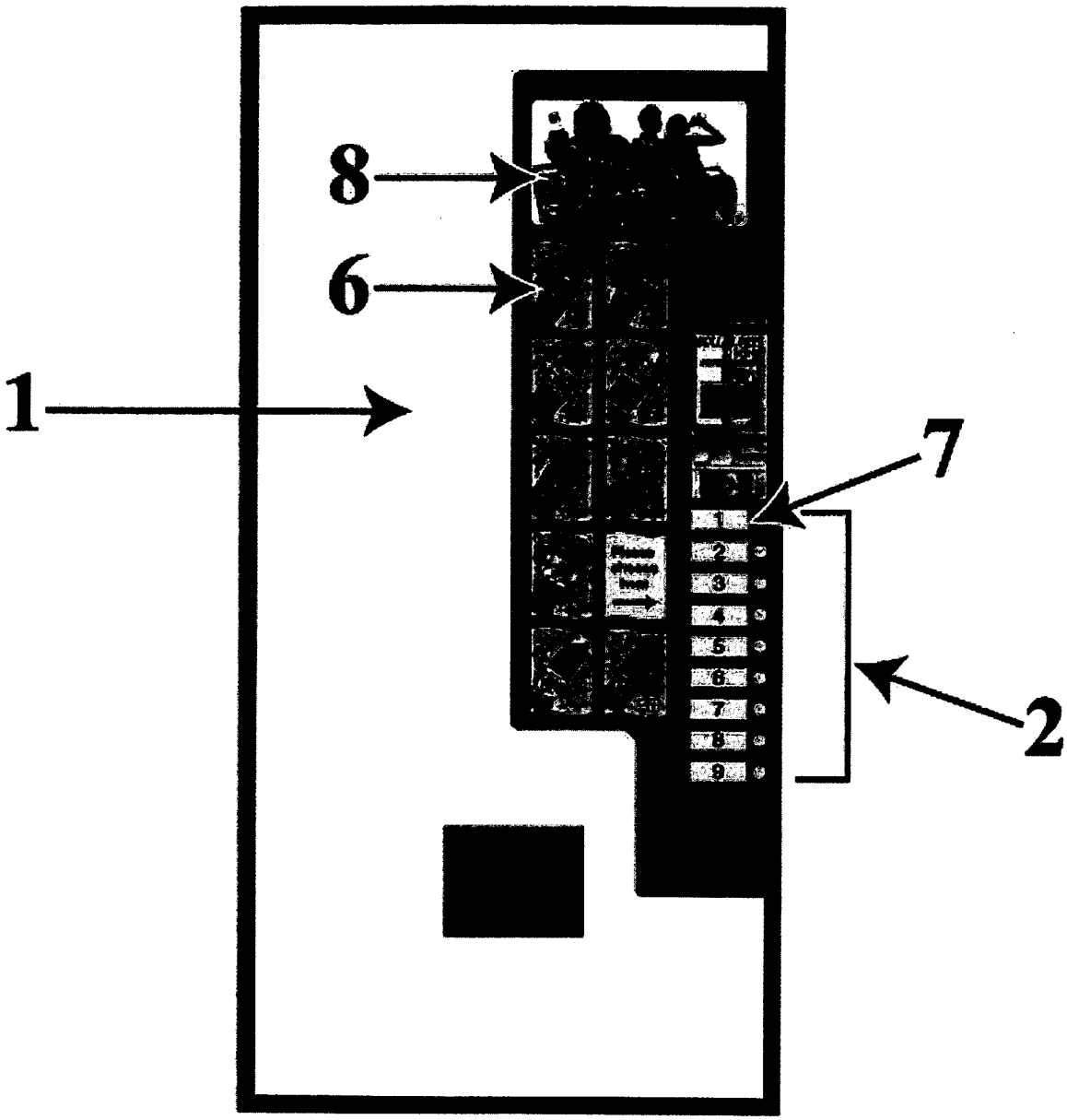
FIG. 8 is a front elevational view of the embodiment of FIG. 4 with graphics installed.

FIG. 8 is a front elevational view of the embodiment of FIG. 4 with graphics installed, including an advertising image installed to be viewed through advertising window 8.

Figures 9, 10:
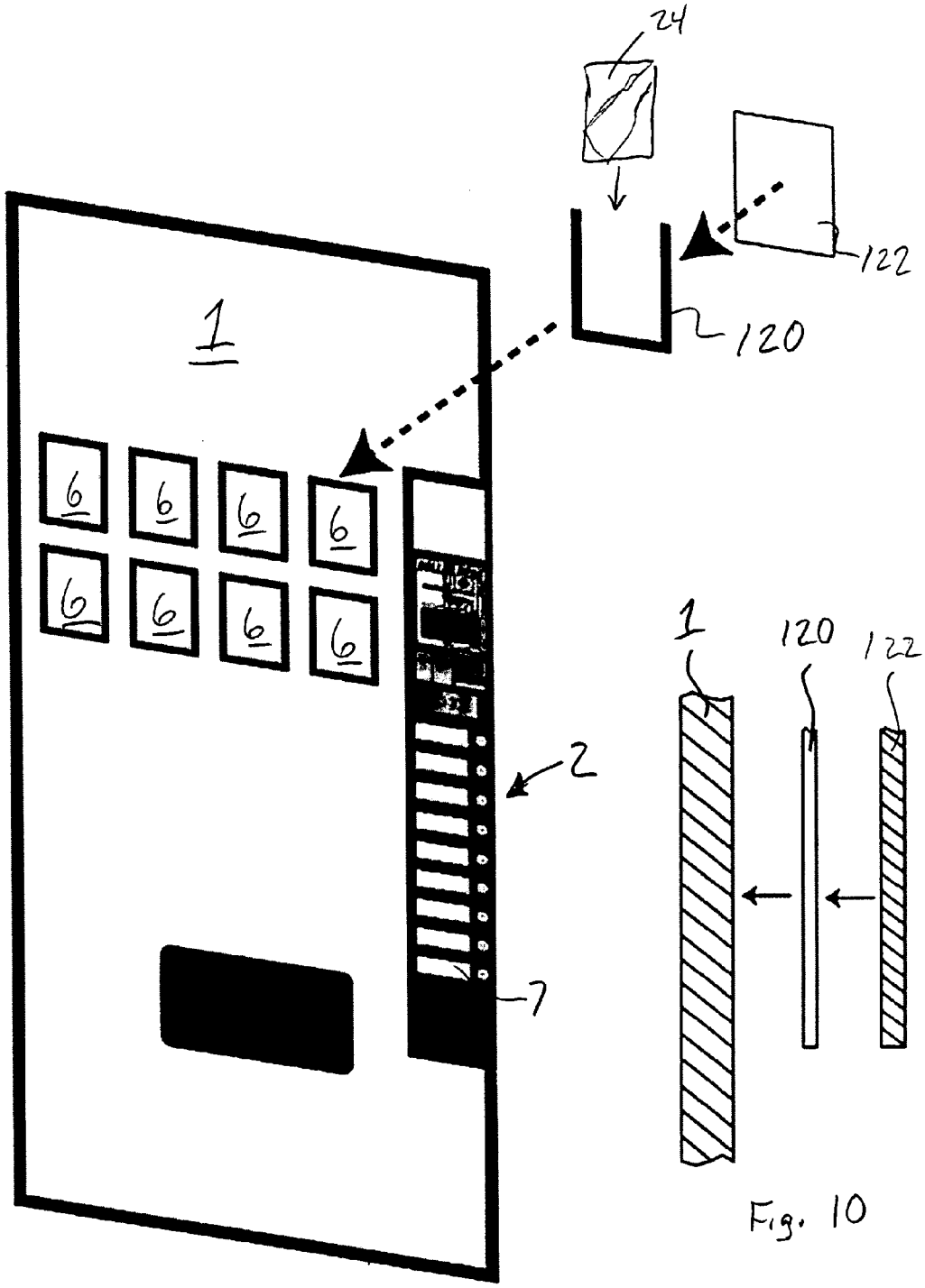
FIG. 9 is a front elevational view of an alternative embodiment of the invention.
FIG. 10 is a partial side sectional view of the embodiment of FIG. 9.

FIGS. 9 and 10 show an alternative embodiment of the holder of the present invention. Here the remote product identifiers 24 are retained between the sign 1 and a backing plate 122. The backing plate 122 is retained to the sign by a spacing member, shown as a u-shaped foam tape 120 adhesively coated on both sides. The foam tape 120 and backing plate 122 are shown as providing a holder for a single product identification indicia. The thickness of the foam tape provides sufficient clearance between the sign 1 and the backing plate 122 to receive the remote product identifier 24 in the pocket formed by the sign 1, u-shaped foam tape 120 and backing plate 122. In the embodiment shown, providing remote product identifiers 24 for each of the eight products contained in the machine would require eight such sets of foam tape 120 and backing plate 122. Alternatively, the foam tape and backing plate can be formed as a lattice, similar to that described herein or in other desired shapes. The tape 120 can alternatively be replaced by a more rigid component having a thickness which is sufficient to receive the product identification indicia and which is fastened to the sign 1 and backing plate 120 with tape, adhesive and/or other fasteners.

With the present invention as disclosed in the various embodiments above, a retrofit kit can be supplied for various types of older style vending machines that allows the upgrading of the appearance of the machine to a style similar to the marketing graphics of new vending machines merely by the replacement of the existing sign 1 with the present invention sign/holder assembly as described above and, optionally, the graphics associated with the selection panel 2 and selection panel windows 7 and buttons 28. Since in the preferred embodiment, no modifications to the vending machine or other components are needed to retrofit the older style machine, the cost of the retrofit is but a fraction of the cost of the replacement of the machine. The present invention retrofit kit uses the machine's existing signage lighting and can be installed on the vending machine with the same tools required to change the sign 1 and in approximately the same amount of time. Thus, the preferred new style marketing graphics can be used on an older style vending machine without incurring the cost of replacing the entire vending machine. Since signage is routinely replaced at 3-5 year intervals, the cost of the retrofit can be further reduced by retrofitting machines at the time signage replacement would be otherwise desired or required (including signage replacement required because of damage or vandalism to the sign). Graphics for the holder openings 6, selection panel 2 and buttons 7 are easily replaceable, either as group units or individually, to change images and/or product selections.

It is also contemplated that switching structure can be incorporated in to the retrofit kit such that manipulation or touching of some portion of the graphic images 21, or the structure associated therewith, will trigger the vend cycle instead of, or in addition to, the product selection buttons 28. Such switching structure can be in the form of membrane switches, magnetic effect or Hall-effect switches, optical switches or any other known types of switches. The switching structure can be incorporated with the structure of the retrofit kit, for instance in the form of a circuit board added to the retrofit assembly with electrical connection leads coming off the assembly for connection to existing circuitry of the vending machine. It is also contemplated that additional lighting sources can be added to the retrofit kit for enhanced lighting of the graphics and images and that this lighting would likewise be connectable to existing machine circuitry. Other components can also be similarly incorporated into the retrofit kit, including sound and/or music generating devices. Such devices, for instance, can signify when a vend selection has been successfully completed.

It is intended that aspects of the invention as described above can be used in any number of different combinations and permutations.

What is claimed is:

1. A signage retrofit fit kit for a vending machine, comprising:

a sign having a front side visible by a customer of the vending machine and a rear side facing the vending machine, the sign being attachable to a front portion of the vending machine and having at least one window portion through which an item located on the rear side of the sign can be viewed from the front side of the sign, the window portion being spaced apart from a product identification window of a selection panel of the vending machine and having a size greater than a size of the selection panel product identification window; and a holder constructed and arranged to be positioned on the rear side of the sign, the holder also constructed and arranged to hold a remote product identifier such that the remote product identifier is viewable from the front side through the window portion of the sign, the remote product identifier also having a size greater than the size of the selection panel product identification window;

wherein the holder comprises:

a backing plate attachable to the rear side of the sign, the remote product identifier being positionable between the sign and the backing plate;

a spacing member positionable between the rear side of the sign and the backing plate to space the backing plate away from the rear side and provide a channel for retaining the remote product identifier;

wherein the backing plate and spacing member are attached to the rear side of the sign with adhesive.

2. The signage retrofit kit of claim 1, wherein the spacing member is constructed of foam and is adhesively coated on both sides to attach to both the rear side of the sign and to the backing plate.

3. A signage retrofit fit kit for a vending machine, comprising:

a sign having a front side visible by a customer of the vending machine and a rear side facing the vending machine, the sign being attachable to a front portion of the vending machine and having a plurality of window portions through which items located on the rear side of the sign can be viewed from the front side of the sign, the window portions being spaced apart from positions of product identification windows of an original selection panel of the vending machine and having sizes greater than sizes of the original selection panel product identification windows; and a holder constructed and arranged to be positioned on the rear side of the sign, the holder also constructed and arranged to hold at least one remote product identifier such that the remove product identifier is viewable from the front side through one of the window portions of the sign, the remote product identifier also having a size greater than the size of each of the original selection panel product identification windows;

wherein the holder comprises:

a backing plate attachable to the rear side of the sign, the remote product identifier being positionable between the sign and the backing plate;

a spacing member positionable between the rear side of the sign and the backing plate to space the backing plate away from the rear side and provide a channel for retaining the remote product identifier;

wherein the backing plate and spacing member are attached to the rear side of the sign with adhesive;

and further including a plurality of the remote product identifier, each of the plurality visible to the customer through a corresponding window portion.

4. The signage retrofit kit of claim 3, wherein the spacing member is constructed of foam and is adhesively coated on both sides to attach to both the rear side of the sign and to the backing plate.

5. The signage retrofit kit of claim 3, the kit further comprising:

a plurality of switches attached to the sign, each associated with a remote product identifier and operatively connectable to existing circuitry of the vending machine such that manipulation of a switch can trigger a vend cycle for a product associated with the associated remote product identifier.

* * * * *